US012673236B2

(12) United States Patent
Lin

(10) Patent No.: US 12,673,236 B2
(45) Date of Patent: Jul. 7, 2026

(54) TREADMILL WITH UPWARD/DOWNWARD INCLINATION ANGLE ADJUSTMENT STRUCTURE

(71) Applicant: Tsung-Chou Lin, Tainan City (TW)

(72) Inventor: Tsung-Chou Lin, Tainan City (TW)

( * ) Notice: Subject to any disclaimer, the term of this patent is extended or adjusted under 35 U.S.C. 154(b) by 77 days.

(21) Appl. No.: 18/659,505

(22) Filed: May 9, 2024

(65) Prior Publication Data

US 2025/0288861 A1 Sep. 18, 2025

(30) Foreign Application Priority Data

Mar. 18, 2024 (TW) ..... 113202686

(51) Int. Cl.
*A63B 22/02* (2006.01)
*A63B 22/00* (2006.01)
*A63B 24/00* (2006.01)

(52) U.S. Cl.
CPC ..... *A63B 22/0235* (2013.01); *A63B 22/0023* (2013.01); *A63B 24/0087* (2013.01)

(58) Field of Classification Search
None
See application file for complete search history.

(56) References Cited

U.S. PATENT DOCUMENTS 4,423,864 A * 1/1984 Wiik ..... A63B 22/203 472/91
5,333,876 A * 8/1994 Goto ..... A63B 69/3652 473/134
5,385,519 A * 1/1995 Hsu ..... A63B 22/0023 482/902
6,179,724 B1 * 1/2001 Yang ..... A63B 69/3652 473/279
2002/0128084 A1 * 9/2002 Lee ..... A63B 57/0006 473/134
2010/0056289 A1 * 3/2010 Zhou ..... A63B 69/3652 473/279
2018/0154208 A1 * 6/2018 Powell ..... A63B 24/0087
2021/0245012 A1 * 8/2021 Kumar ..... A63B 21/00181
2022/0080284 A1 * 3/2022 Churchman ..... A63B 22/0242

FOREIGN PATENT DOCUMENTS

CN 108066949 A * 5/2018 ..... A61B 5/4023
CN 108939455 A * 12/2018 ..... A63B 26/003
TW M257845 U 3/2005
TW M433217 U 7/2012

* cited by examiner

*Primary Examiner* — Shila Jalalzadeh Abyaneh
(74) *Attorney, Agent, or Firm* — Rosenberg, Klein & Lee

(57) ABSTRACT

A treadmill with an upward/downward inclination angle adjustment structure includes: a base with a pivotal connection point provided above the base; a frame with a front connecting end, an opposite rear connecting end, and a pivotal connection end between the front and rear connecting ends, wherein the frame is pivotally connected to the pivotal connection point through the pivotal connection end and is thus provided on the base; and a chain and a motor for driving the chain, wherein the chain has two opposite ends each connected to one of the front and rear connecting ends and is looped around the motor for driving the chain, thereby allowing the frame to simulate an upward or downward hill.

8 Claims, 10 Drawing Sheets

TREADMILL WITH UPWARD/DOWNWARD INCLINATION ANGLE ADJUSTMENT STRUCTURE

BACKGROUND OF THE INVENTION

1. Technical Field

The present invention relates to a treadmill with an upward/downward inclination angle adjustment structure. More particularly, the invention relates to a structure capable of adjusting the upward/downward inclination angle of a treadmill.

2. Description of Related Art

To relieve daily work stress or keep fit, people tend to do outdoor sports or fitness/physical training purposely. Such sports or training can be divided into aerobic exercise and anaerobic exercise. Aerobic exercise is intended mainly to enhance cardiopulmonary functions and to consequently shape a person's body figure by burning body fat. Anaerobic exercise, on the other hand, is often referred to as resistance training or weight training and serves mainly to increase muscle strength and the load capacity of muscles.

Some common examples of aerobic exercise are running, swimming, and rope jumping, and when it comes to the sport of running, most people would choose to train outdoors so as to take the opportunity to also enjoy the sunshine or a gentle breeze. If there are site limitations or if the weather does not allow, running indoors on a treadmill is still an option.

When using a treadmill, a user may switch among different training modes according to their physical conditions. For example, the user may increase the speed of the treadmill, change the resistance of the running belt, or adjust the slope of the treadmill to simulate running uphill. This has been made possible by, for example, Taiwan Utility Model Patent No. M257845, which is entitled "DEVICE FOR ADJUSTING INCLINATION ANGLE OF TREADMILL RUNNING DECK" and discloses an inclination angle adjustment device provided adjacent to a terminal end of a running deck. By adjusting, and securing the position of, the inclination angle adjustment device, the running deck can be inclined at the most suitable inclination angle to meet the user's running needs. The inclination angle adjustment device includes a supporting member, an adjusting and positioning member, and an elastic member. The adjusting and positioning member works together with the elastic member to adjust and position the supporting member, in order for the supporting member to hold the running deck at the desired inclination angle. The inclination angle adjustment device is structurally simple, easy to operate, and effective.

In addition, Taiwan Utility Model Patent No. M433217, entitled "TREADMILL," mainly discloses a treadmill that includes a running deck, a pivoting unit, and two slope adjustment blocks. The running deck has two longitudinal-axis supporting members. The pivoting unit is provided under the running deck and can be pivoted with respect to the longitudinal-axis supporting members. Each slope adjustment block has an eccentric shaft and a plurality of supporting surfaces that are parallel to the axis of the shaft and configured to be supported on the ground. Each of the supporting surfaces and the axis of the shaft define a vertical distance therebetween, and at least two of the vertical distances are different from each other. The shaft of each slope adjustment block is pivotally provided at the pivoting unit, with the slope adjustment blocks located on the outer sides of the longitudinal-axis supporting members. The running deck of the treadmill, therefore, has a plurality of slopes to any of which the running deck can be manually adjusted.

Both utility models cited above allow the angle of the supporting member for connecting the running deck to the ground to be adjusted in order to change the relative positions of the running deck and the ground and thereby adjust the slope of the running deck. Moreover, both utility models are configured for manual adjustment, but such an adjustment can only render the running deck into an upwardly inclined state; that is to say, the running deck cannot simulate a downward hill.

BRIEF SUMMARY OF THE INVENTION

Therefore, to make it easier to adjust the inclination angle of a treadmill, and to make it possible to adjust a treadmill to a downward slope as well as an upward slope, the present invention provides a treadmill that has an upward/downward inclination angle adjustment structure. More specifically, the treadmill includes a base unit, a running belt unit, an adjustment unit, and a control unit.

The base unit has a base that extends in a horizontal direction and a vertical post that is provided upright in a height direction. The end of the vertical post that is located away from the base is provided with a pivotal connection point. The running belt unit has a frame, a running belt body, and a motor for driving the running belt body. The motor for driving the running belt body is fixed on the frame and is connected to the running belt body. The running belt body is provided in such a way that it surrounds the frame and can be moved around the frame cyclically in the horizontal direction. The frame has a front connecting end, an opposite rear connecting end, and a pivotal connection end between the front connecting end and the rear connecting end. The frame is pivotally connected to the pivotal connection point through the pivotal connection end and is thus provided on the base in a swingable, or pivotable, manner. The adjustment unit has a chain and a motor for driving the chain. The motor for driving the chain includes a motor body, a reduction drive, and a driving sprocket. The motor body is fixed on the base and is connected to the reduction drive. The driving sprocket is provided on the output shaft of the reduction drive. The two opposite ends of the chain are each connected to one of the front connecting end and the rear connecting end, and the chain is looped around the driving sprocket. The control unit is electrically connected to the motor for driving the chain and the motor for driving the running belt body. The motor for driving the chain drives the driving sprocket into rotation and thereby moves the chain in order to pivot the frame with respect to the base on a fulcrum defined by the pivotal connection end, wherein the frame can be pivoted in a selective manner to either form an upward inclination angle between the frame and the base by bringing the rear connecting end close to the base and moving the front connecting end away from the base, or form a downward inclination angle between the frame and the base by moving the rear connecting end away from the base and bringing the front connecting end close to the base.

The adjustment unit has four idler-wheels. The four idler-wheels are pivotally provided on the base in a sequential manner along the horizontal direction. Two of the idler-wheels (hereinafter referred to as the two first idler-wheels) are provided between the driving sprocket and the front connecting end, and the other two idler-wheels (hereinafter referred to as the two second idler-wheels) are provided between the driving sprocket and the rear connecting end. The chain is looped around the four idler-wheels in such a way that the portion of the chain that is looped between the two first idler-wheels and the portion of the chain that is looped between the two second idler-wheels extend parallel to the horizontal direction.

The adjustment unit further has an elastically movable idler-wheel. The elastically movable idler-wheel is provided on the base in an elastically movable manner and is pressed against the chain. Moreover, the elastically movable idler-wheel is provided between the front connecting end and one of the idler-wheels that is adjacent to the front connecting end.

The base has a rear-end abutting portion. When the frame is pivoted in such a way that the frame forms the upward inclination angle with the base and contacts the base, the frame abuts against the rear-end abutting portion.

The treadmill further has a plurality of reinforcing support members. Each of the reinforcing support members has one end connected to the vertical post and the other end connected to the base.

In addition, two reinforcing frame members are provided on a bottom portion of the frame and are each adjacent to one of the two opposite ends of the frame in the horizontal direction. Each of the front connecting end and the rear connecting end is provided at one of the two reinforcing frame members.

The treadmill further has a touchscreen electrically connected to the control unit.

The running belt unit has a handrail, and the handrail is provided upright on the frame. The handrail and the running belt body jointly define a running space.

Moreover, a cover is connected between the base and the frame, is collapsible in the height direction, and extends along the periphery of the base and the periphery of the frame.

The foregoing technical features can produce the following effects:

1. The motor for driving the chain can be controlled via the touchscreen according to practical needs in order to swing, or pivot, the frame, making the running belt unit and the base unit either form an upward inclination angle to simulate an upward hill or form a downward inclination angle to simulate a downward hill. This technical feature allows the angle of the running belt unit to be adjusted with ease.

2. When the motor for driving the chain is stopped, the driving sprocket, which is connected to the motor for driving the chain, will not only stop, but also keep the chain still, thereby allowing the frame to stay at any position.

3. When the frame contacts the base and abuts against the rear-end abutting portion, the elastically movable idler-wheel, which is provided at the other end of the base, remains pressed against the chain to keep the tension of the chain.

4. The cover, which connects the base and the frame, encloses the adjustment unit and thereby prevents the adjustment unit from exposure, lest a user contact the adjustment unit by accident and be injured as a result. The cover also helps enhance the look of the treadmill as a whole.

DETAILED DESCRIPTION OF THE INVENTION

Figure 1:
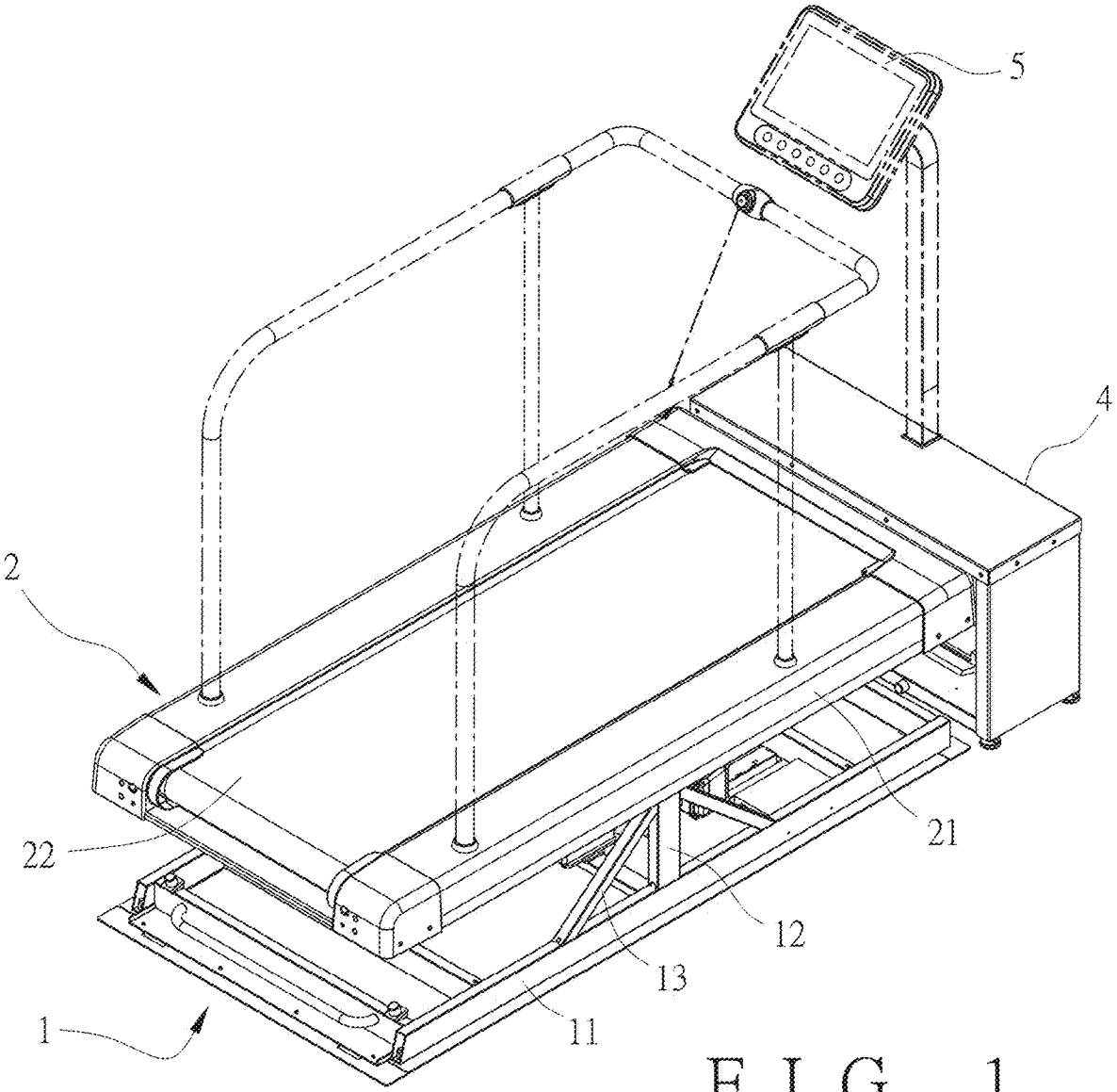
FIG. 1 is a perspective view of the present invention.

The technical features stated above are incorporated into a treadmill having an upward/downward inclination angle adjustment structure and whose major effects are demonstrated by the following embodiment.

Referring to FIG. 1, FIG. 2, FIG. 3, FIG. 4, and FIG. 5, a treadmill with an upward/downward inclination angle adjustment structure according to the present invention includes a base unit 1, a running belt unit 2, an adjustment unit 3, and a control unit 4.

The base unit 1 has a base 11 that extends in a horizontal direction and a vertical post 12 that is provided upright in a height direction, wherein the end of the vertical post 12 that is located away from the base 11 is provided with a pivotal connection point 121. More specifically, the base 11 is a rectangular structure and has two long sides, two short sides, and a plurality of reinforcing members connecting the long sides. Here, two vertical posts 12 are provided, each standing upright on, and located exactly at the midpoint of, one of the two long sides. The base 11 has a plurality of reinforcing support members 13, and each reinforcing support member 13 is connected to the corresponding vertical post 12 at one end and the base 11 at the other end such that the reinforcing support members 13, the vertical posts 12, and the base 11 form triangular structures. The two short sides are each located at one of the two opposite ends of the base 11 in the horizontal direction, and there are two rear-end abutting portions 14 provided at one of the short sides.

The running belt unit 2 has a frame 21, a running belt body 22, and a motor 23 for driving the running belt body. The motor 23 for driving the running belt body is fixed on the frame 21 and is connected to the running belt body 22. The running belt body 22 is provided in such a way that it surrounds the frame 21 and can be moved cyclically around the frame 21 along the horizontal direction. The frame 21 has two opposite ends in the horizontal direction, namely a front connecting end 211 and a rear connecting end 212, and a pivotal connection end 213 between the front connecting end 211 and the rear connecting end 212. The frame 21 is pivotally connected to the pivotal connection point 121 via the pivotal connection end 213 and is thus provided on the base 11 in such a way that the frame 21 can be swung, or pivoted. More specifically, the frame 21 is also rectangular to correspond in shape to the base 11. Two reinforcing frame members 214 are provided on a bottom portion of the frame 21 and are each located adjacent to one of the two opposite ends of the frame 21 in the horizontal direction. Each of the front connecting end 211 and the rear connecting end 212 is provided at one of the two reinforcing frame members 214. The reinforcing frame members 214 are hollow tubes each having a rectangular cross section. In addition, a handrail is provided upright on the frame 21. The handrail and the running belt body 22 jointly define a running space. The method by which the motor 23 for driving the running belt body drives the running belt body 22 into cyclic movement around the frame 21 is well known in the art and therefore will not be described any further.

The adjustment unit 3 has a chain 31, a motor 32 for driving the chain, four idler-wheels 33, and an elastically movable idler-wheel 34. The motor 32 for driving the chain includes a motor body 323, a reduction drive 322, and a driving sprocket 321. The two opposite ends of the chain 31 are each connected to one of the front connecting end 211 and the rear connecting end 212, and the chain 31 is looped around the driving sprocket 321, the four idler-wheels 33, and the elastically movable idler-wheel 34. The motor body 323 is fixed on the base 11 and is connected to the reduction drive 322. The driving sprocket 321 is provided on the output shaft of the reduction drive 322. The four idler-wheels 33 are rotatably provided on the base 11 and sequentially arranged along the horizontal direction. Two of the idler-wheels 33 (hereinafter referred to as the two first idler-wheels 33) are provided between the driving sprocket 321 and the front connecting end 211, and the other two idler-wheels 33 (hereinafter referred to as the two second idler-wheels 33) are provided between the driving sprocket 321 and the rear connecting end 212. The portion of the chain 31 that is looped between the two first idler-wheels 33 and the portion of the chain 31 that is looped between the two second idler-wheels 33 extend in a direction parallel to the horizontal direction. A protective shield covers the four idler-wheels 33 and the aforesaid portions of the chain 31 that are each looped between the corresponding two first or second idler-wheels 33. The elastically movable idler-wheel 34 is provided on the base 11 in an elastically movable manner, and the elastically movable idler-wheel 34 is provided between the front connecting end 211 and the idler-wheel 33 that is adjacent to the front connecting end 211. More specifically, the elastically movable idler-wheel 34 is provided on the protective shield in a swingable manner through a swinging arm, and there are two springs 35 each having one end connected to the swinging arm of the elastically movable idler-wheel 34 and the other end connected to the protective shield. The springs 35 exert an elastic force that pulls the swinging arm and thereby keeps the elastically movable idler-wheel 34 pressed against the chain 31.

The control unit 4 is electrically connected to the motor 32 for driving the chain and the motor 23 for driving the running belt body. A touchscreen 5 is electrically connected to the control unit 4.

Figure 2:
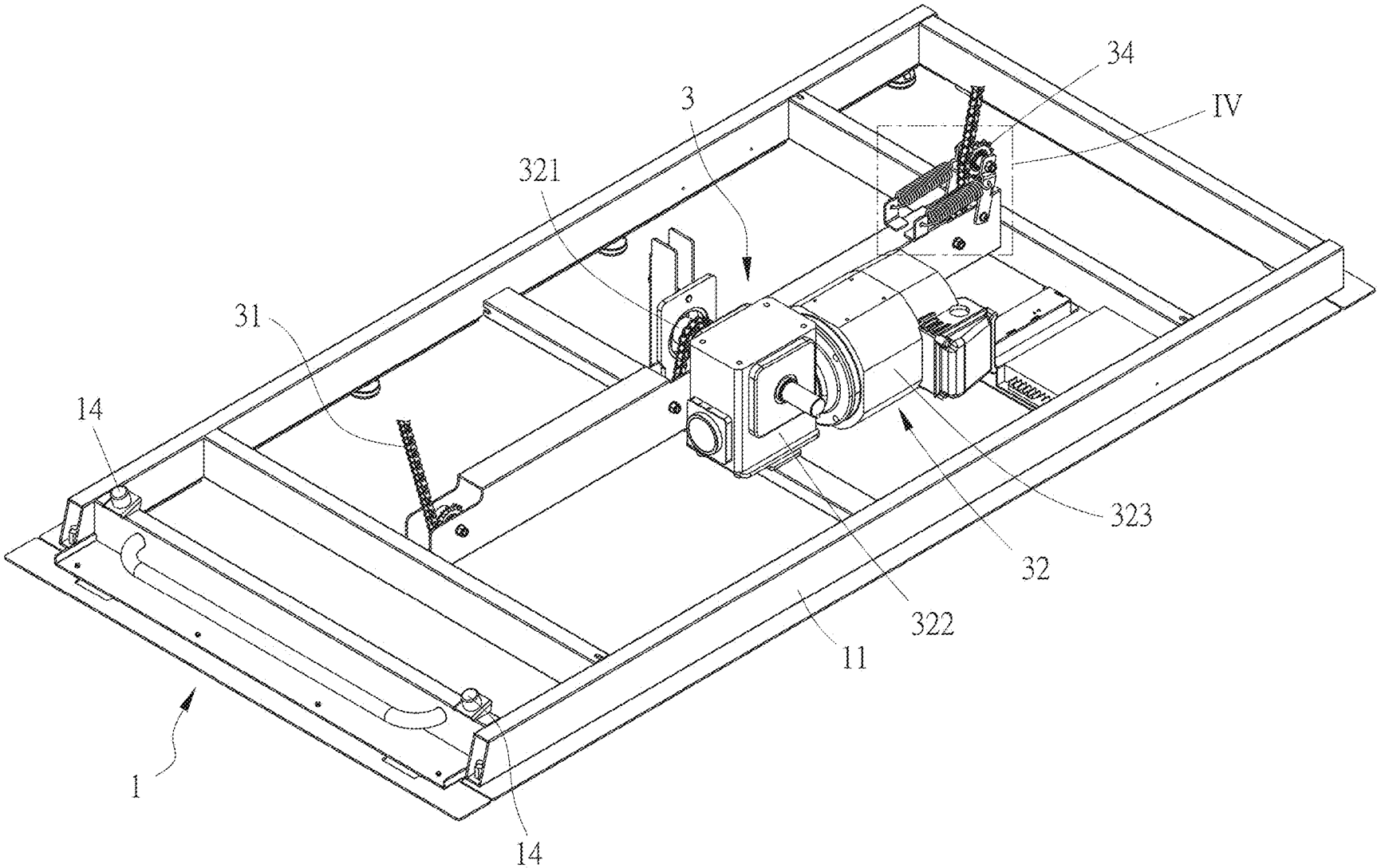
FIG. 2 is a perspective view of a portion of the present invention.
Figure 3:
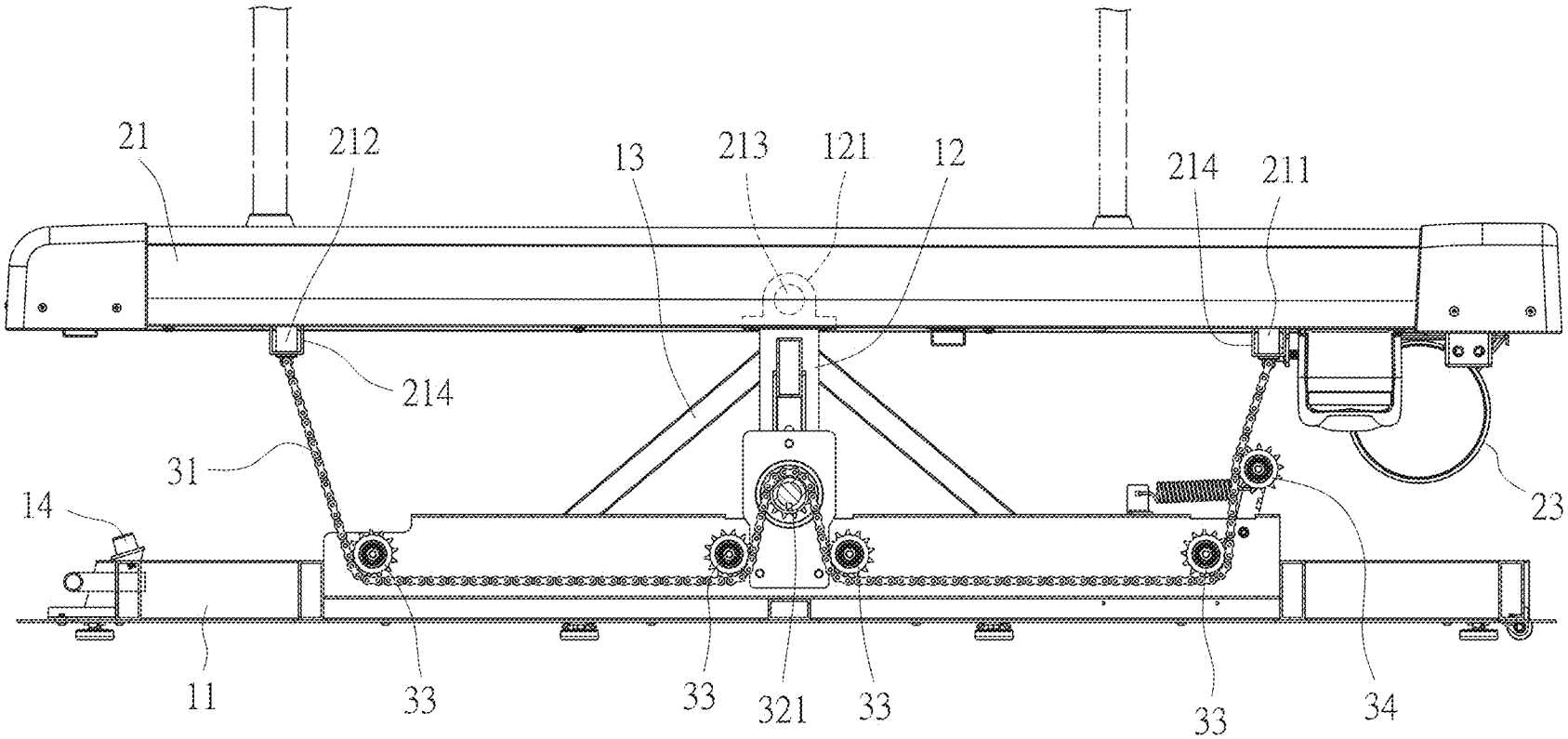
FIG. 3 is a sectional view of the present invention.
Figure 4:
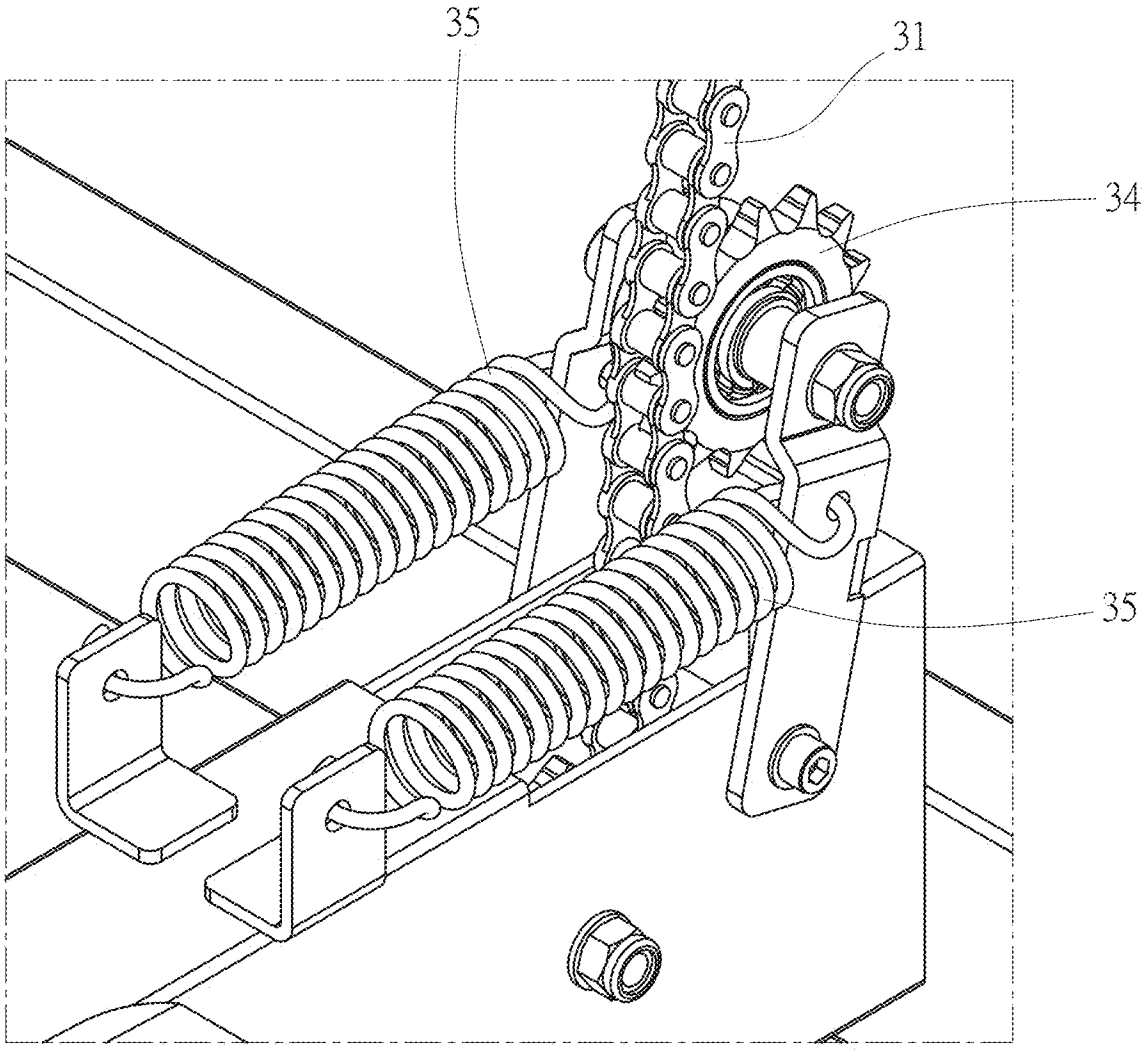
FIG. 4 is a perspective view of the elastically movable idler-wheel in the present invention.
Figure 5:
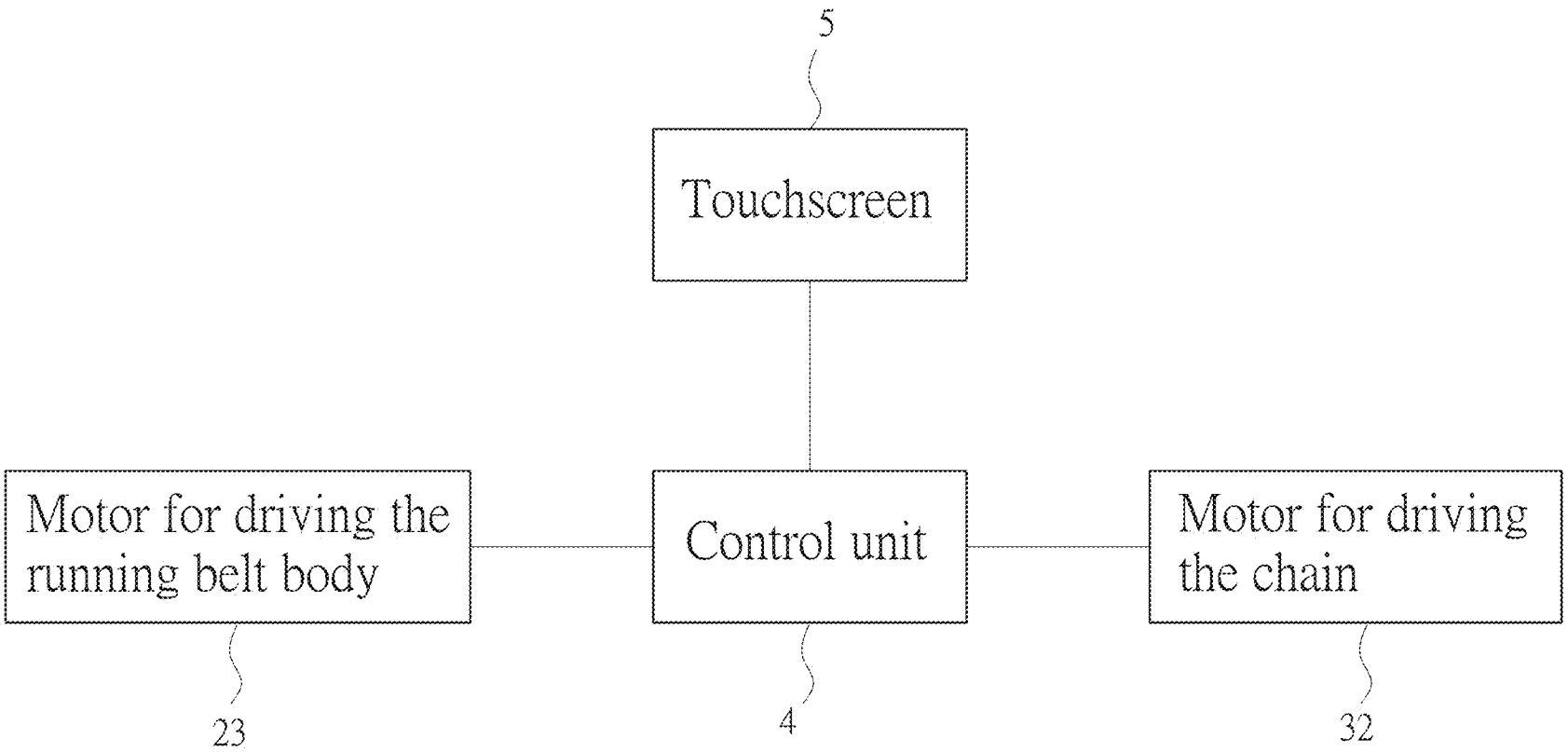
FIG. 5 is a block diagram of the present invention.
Figure 6:
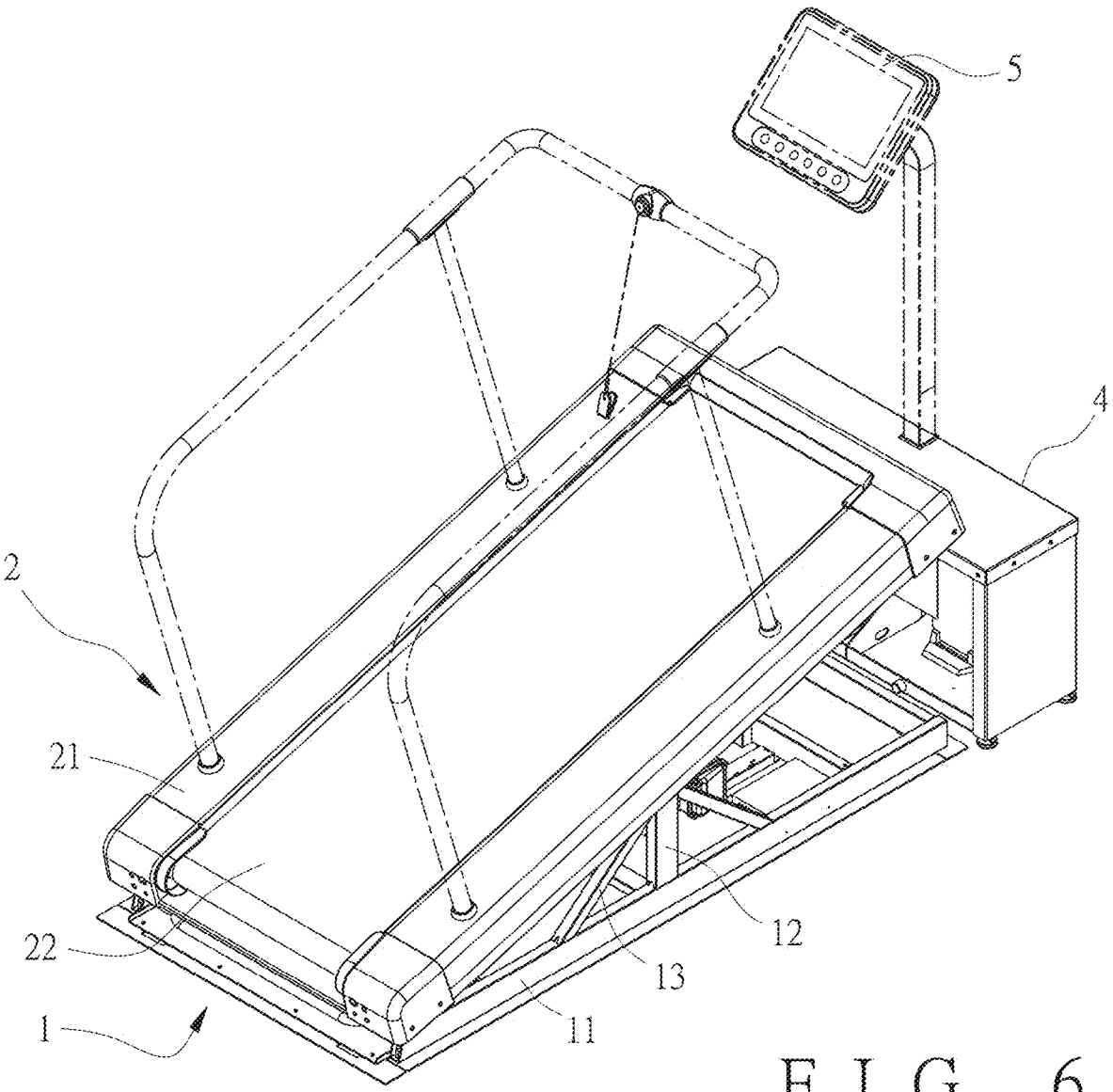
FIG. 6 shows a state of use of the present invention, with the frame and the base forming an upward inclination angle to simulate an upward hill.
Figure 7:
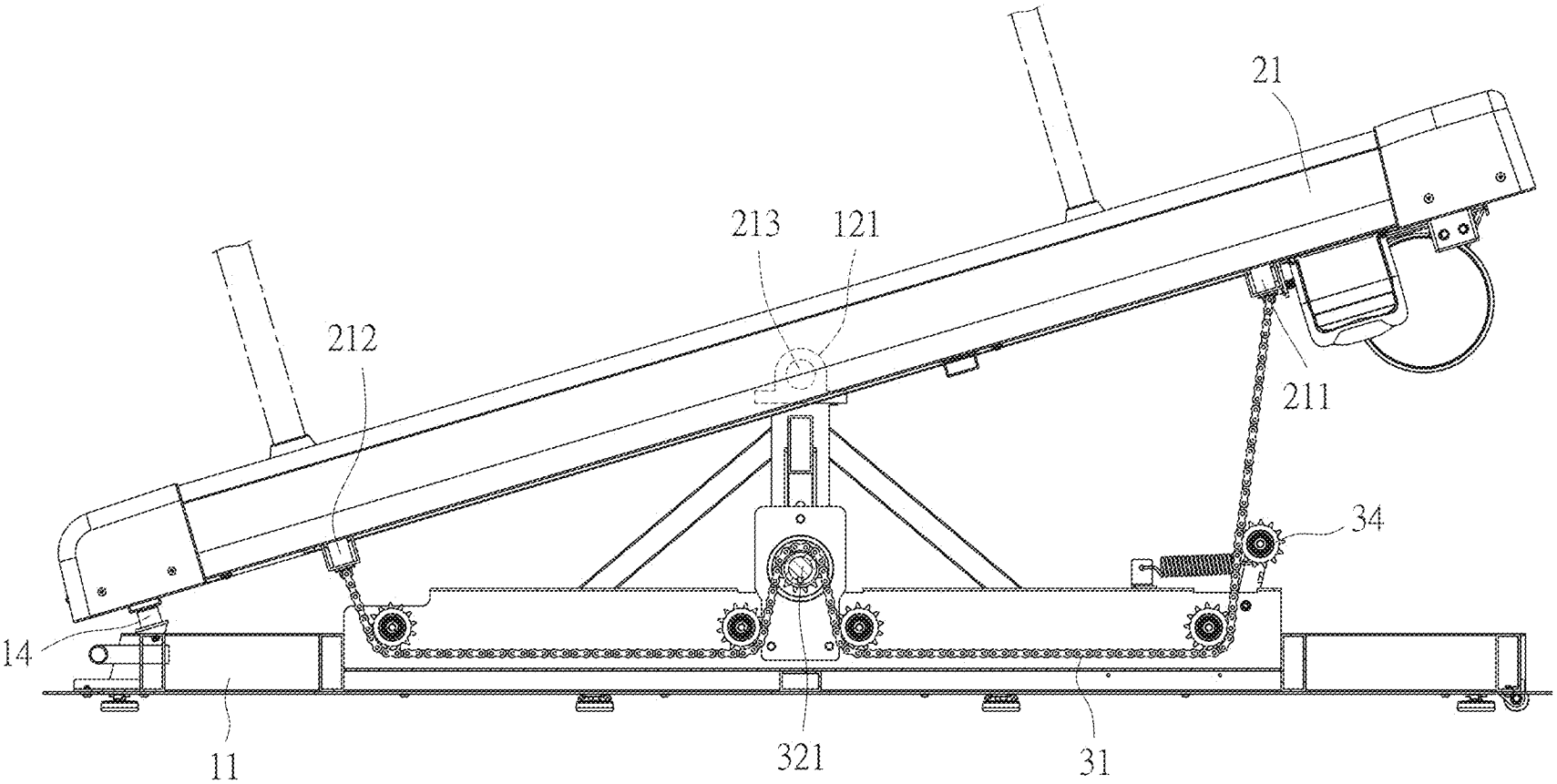
FIG. 7 is a sectional view of the present invention, showing the frame and the base forming an upward inclination angle.

Referring to FIG. 6 and FIG. 7 in conjunction with FIG. 2, not only can the running belt unit 2 be used in a horizontal state, but also the present invention allows the angle of the running belt unit 2 to be adjusted to simulate an upward hill. More specifically, the motor 32 for driving the chain can be started in order for the motor 32 for driving the chain to drive the driving sprocket 321 into rotation and thereby move the chain 31. In consequence, one end of the chain 31 will be driven toward the driving sprocket 321 by the driving sprocket 321 and thus pull the frame 21. The frame 21, therefore, is pivoted on a fulcrum defined by the pivotal connection end 213, with the pivoting direction of the frame 21 determined by the direction in which the driving sprocket 321 is driven to rotate by the motor 32 for driving the chain. For example, when the frame 21 is so pulled that the rear connecting end 212 of the frame 21 is brought close to the base 11 while the front connecting end 211 is moved away from the base 11, the portion of the chain 31 that is connected to the front connecting end 211 will be pulled by the frame 21, and the tension of the chain 31 will be maintained at a certain level by the pull to prevent the chain 31 from slackening. In the meantime, the elastically movable idler-wheel 34 will stay pressed against the chain 31 to help maintain the tension of the chain 31, regardless of the position of the chain 31 after the frame 21 is pivoted. Consequently, the frame 21 and the base 11 form an upward inclination angle to simulate an upward hill. When the upward inclination angle is adjusted to the maximum value, the frame 21 will abut against the rear-end abutting portions 14 and can therefore be securely supported on the base 11.

Figure 8:
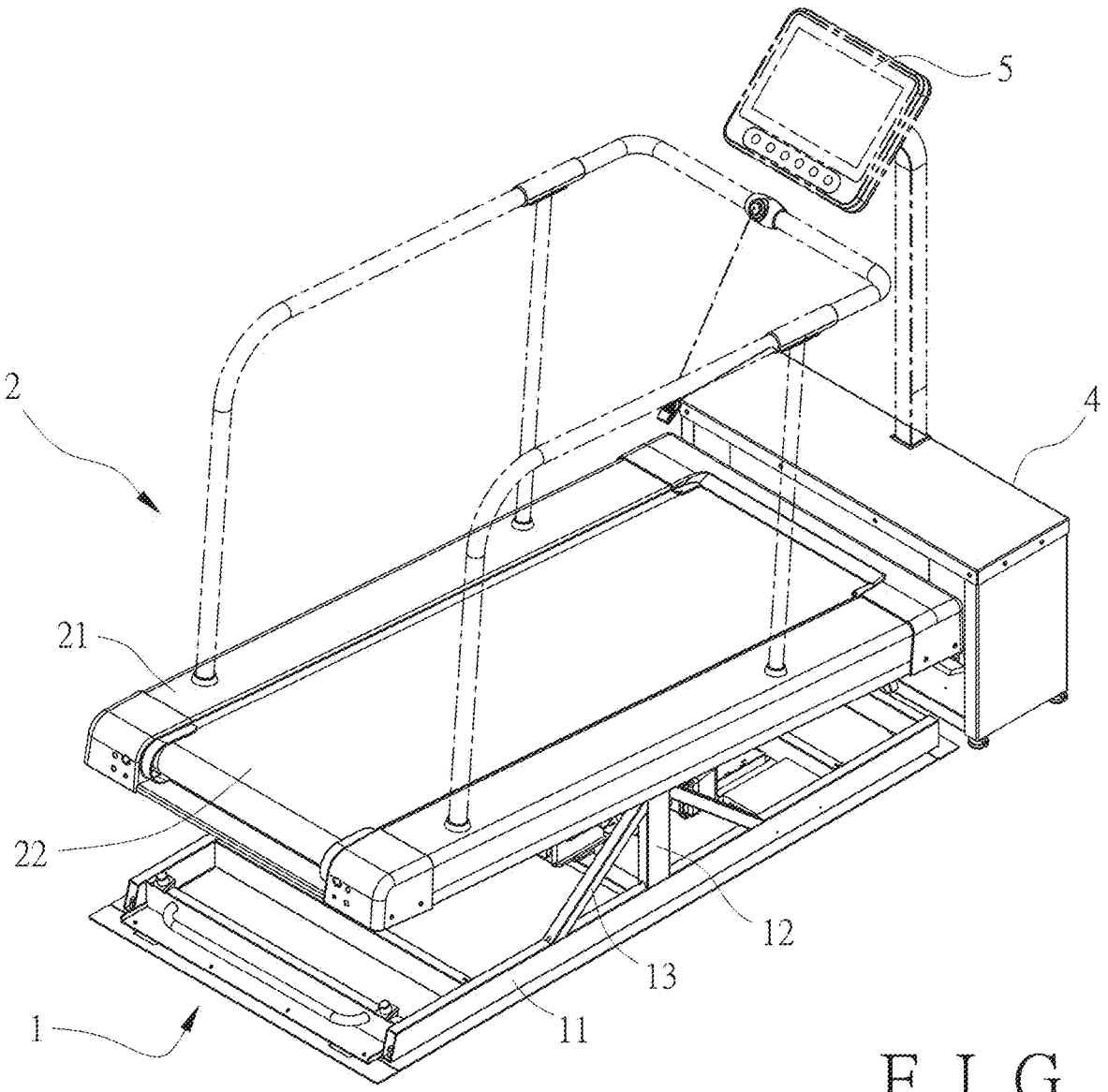
FIG. 8 shows another state of use of the present invention, with the frame and the base forming a downward inclination angle to simulate a downward hill.
Figure 9:
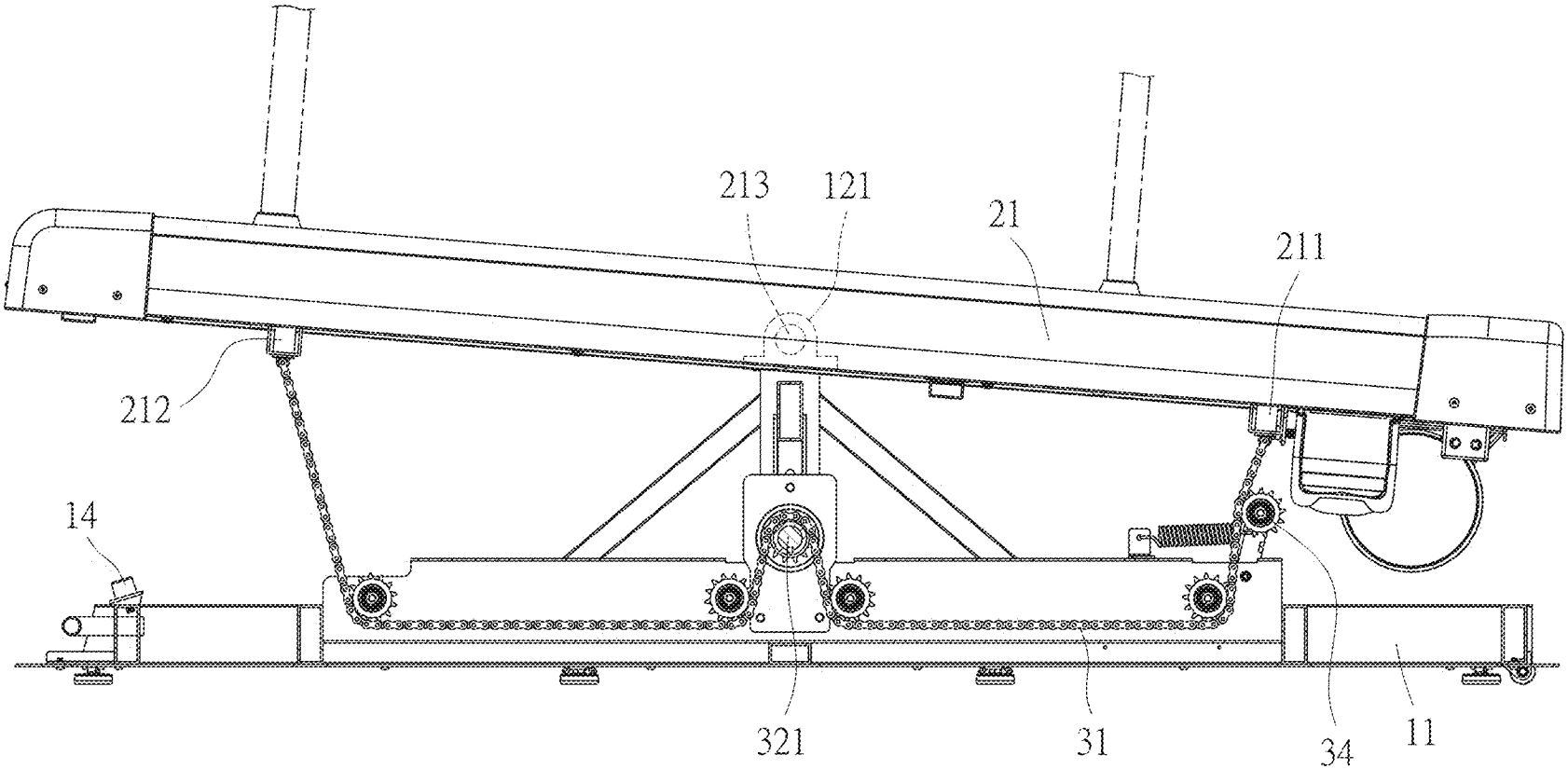
FIG. 9 is a sectional view of the present invention, showing the frame and the base forming a downward inclination angle.

Referring to FIG. 8 and FIG. 9 in conjunction with FIG. 2, the present invention also allows the angle of the running belt unit 2 to be adjusted to simulate a downward hill. More specifically, the motor 32 for driving the chain can be used to drive the driving sprocket 321 into rotation in a way similar to that described in the previous paragraph and thereby move the chain 31, the difference being that the direction in which the driving sprocket 321 is rotated is opposite to that described in the previous paragraph. As a result, the front connecting end 211 of the frame 21 is brought close to the base 11 while the rear connecting end 212 is moved away from the base 11, and the frame 21 and the base 11 form a downward inclination angle to simulate a downward hill.

Figure 10:
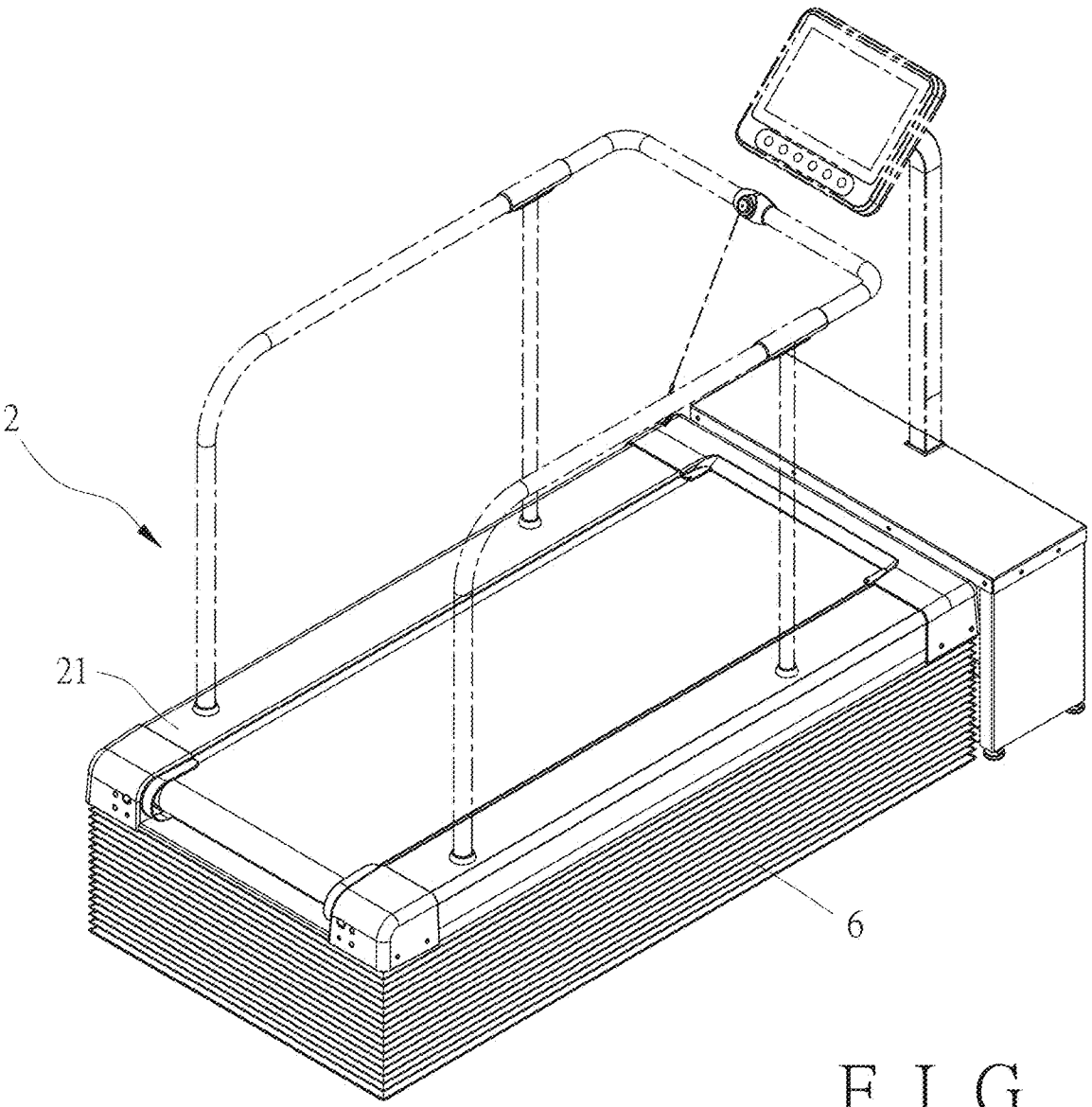
FIG. 10 shows yet another state of use of the present invention, with a cover provided between the frame and the base.

Referring to FIG. 10 in conjunction with FIG. 2, the frame 21 and the base 11 must be spaced apart so that the frame 21 can be swung, or pivoted, with respect to the base 11, and because of that, a receiving space is formed between the frame 21 and the base 11 and can be used to accommodate the adjustment unit 3. To prevent a user from inadvertent contact with the components in the receiving space such as the chain 31 or the motor 32 for driving the chain, the present invention further includes a cover 6. The cover 6 is connected between the base 11 and the frame 21, can be collapsed in the height direction, and extends along the periphery of the base 11 and the periphery of the frame 21 to surround and thereby close the receiving space. The cover 6 not only can keep a user from contact with such components as the chain 31 or the motor 32 for driving the chain, but also helps beautify the external appearance of the invention, lending integrity to the look of the assembly of the base unit 1 and the running belt unit 2.

The embodiment described above should be able to shed sufficient light on the operation, use, and effects of the present invention. The embodiment, however, is only a preferred one of the invention and is not intended to be restrictive of the scope of the invention. Any simple equivalent change or modification that is made according to the appended claims and the contents of this specification shall fall within the scope of the invention.

What is claimed is:

1. A treadmill with an upward/downward inclination angle adjustment structure, comprising:

a base unit having a base extending in a horizontal direction and a vertical post provided upright on the base in a height direction, wherein the vertical post has an end located away from the base and provided with a pivotal connection point;

a running belt unit having a frame, a running belt body, and a motor for driving the running belt body, wherein the motor for driving the running belt body is fixed on the frame and is connected to the running belt body, the running belt body surrounds the frame and is cyclically movable around the frame in the horizontal direction, the frame has a front connecting end and an opposite rear connecting end in the horizontal direction and a pivotal connection end between the front connecting end and the rear connecting end, and the frame is pivotally connected to the pivotal connection point through the pivotal connection end and is thus provided on the base in a swingable, or pivotable, manner;

an adjustment unit having a chain and a motor for driving the chain, wherein the motor for driving the chain includes a motor body, a reduction drive, and a driving sprocket, the motor for driving the chain is fixed on the base and is connected to the reduction drive, the driving sprocket is provided on an output shaft of the reduction drive, and the chain has two opposite ends, each connected to one of the front connecting end and the rear connecting end and is looped around the driving sprocket; and a control unit electrically connected to the motor for driving the chain and the motor for driving the running belt body, wherein the motor for driving the chain drives the driving sprocket into rotation and thereby moves the chain such that the frame is pivoted with respect to the base on a fulcrum defined by the pivotal connection end, either with the rear connecting end brought close to the base and the front connecting end moved away from the base to form an upward inclination angle between the frame and the base, or with the rear connecting end moved away from the base and the front connecting end brought close to the base to form a downward inclination angle between the frame and the base, and wherein the adjustment unit further has four idler-wheels, the four idler-wheels are pivotally provided on the base in a sequential manner along the horizontal direction, two of the idler-wheels are provided between the driving sprocket and the front connecting end, the other two of the idler-wheels are provided between the driving sprocket and the rear connecting end, and the chain is looped around the four idler-wheels in such a way that a portion of the chain that is looped between the two idler-wheels provided between the driving sprocket and the front connecting end and a portion of the chain that is looped between the two idler-wheels provided between the driving sprocket and the rear connecting end extend in a direction parallel to the horizontal direction.

2. The treadmill with an upward/downward inclination angle adjustment structure as claimed in claim 1, wherein the adjustment unit has an elastically movable idler-wheel, the elastically movable idler-wheel is provided on the base in an elastically movable manner and is pressed against the chain, and the elastically movable idler-wheel is provided between the front connecting end and one of said four idler-wheels which is adjacent to the front connecting end.

3. The treadmill with an upward/downward inclination angle adjustment structure as claimed in claim 1, wherein the base has a rear-end abutting portion, and the frame abuts against the rear-end abutting portion when pivoted in such a way that the frame forms the upward inclination angle with the base and contacts the base.

4. The treadmill with an upward/downward inclination angle adjustment structure as claimed in claim 1, further comprising a plurality of reinforcing support members, wherein each of the reinforcing support members has one end connected to the vertical post and an opposite end connected to the base.

5. The treadmill with an upward/downward inclination angle adjustment structure as claimed in claim 1, further comprising two reinforcing frame members on a bottom portion of the frame, wherein each of the reinforcing frame members is provided adjacent to one of two opposite ends of the frame in the horizontal direction, and each of the front connecting end and the rear connecting end is provided at one of the two reinforcing frame members.

6. The treadmill with an upward/downward inclination angle adjustment structure as claimed in claim 1, further comprising a touchscreen electrically connected to the control unit.

7. The treadmill with an upward/downward inclination angle adjustment structure as claimed in claim 1, wherein the running belt unit has a handrail, the handrail is provided upright on the frame, and the handrail and the running belt body jointly define a running space.

8. The treadmill with an upward/downward inclination angle adjustment structure as claimed in claim 1, further comprising a cover, wherein the cover is connected between the base and the frame, is collapsible in the height direction, and extends along a periphery of the base and a periphery of the frame.

* * * * *